United States Patent [19]

Hamparian

[11] 4,213,441

[45] Jul. 22, 1980

[54] ENGINE WITH WALL RIB OIL GAUGE MOUNTING AND DRAIN MEANS

[75] Inventor: Nshan Hamparian, Brighton, Mich.

[73] Assignee: General Motors Corporation, Detroit, Mich.

[21] Appl. No.: 951,499

[22] Filed: Oct. 16, 1978

[51] Int. Cl.[2] ..... F01M 1/00

[52] U.S. Cl. ..... 123/196 R; 123/195 R; 184/1.5; 184/6.4

[58] Field of Search ..... 123/196 R, 196 M, 195 R; 184/6.4, 1.5

[56] References Cited

U.S. PATENT DOCUMENTS

| | | | |
|---|---|---|---|
| 1,246,745 | 11/1917 | Ide | 123/196 M |
| 4,033,312 | 7/1977 | Howe | 123/196 R |
| 4,108,135 | 8/1978 | Kubis | 123/196 R |

*Primary Examiner*—Ronald H. Lazarus
*Attorney, Agent, or Firm*—Robert J. Outland

[57] ABSTRACT

An internal combustion engine is provided with stiffening side wall ribs which are lightened by the provision therein of internal passages that alternatively cooperate with cylinder head passages to provide oil drains from the valve chambers to the oil sump or provide mounting means for an oil level indicating gauge rod. The oil gauge mounting provision includes an angled uniplanar passage in the cylinder block wall aligned with a cylinder head boss and oil pan mounted guide member as well as additional features.

8 Claims, 8 Drawing Figures

ENGINE WITH WALL RIB OIL GAUGE MOUNTING AND DRAIN MEANS

TECHNICAL FIELD

This invention relates to internal combustion engines and, more particularly, to oil gauge mounting means and upper chamber lubricant drain means each of which includes a hollow stiffening rib in the cylinder block wall as a part thereof. Further aspects of the invention relate to engine cylinder head and oil pan modifications which cooperate with the hollow cylinder block wall ribs and associated passages to provide the drain passages and alternately positioned oil gauge mounting arrangement.

BACKGROUND OF THE INVENTION

It is common practice in the field of internal combustion engines, particularly those for use in automotive vehicle application, to provide means on the engine oil pan or cylinder block for mounting a removable oil gauge rod. Many differing locations and means of mounting such an oil gauge or dipstick have in the past been provided that in varying degrees combined the desirable features of low application cost and convenience for engine servicing personnel.

It is also common in engine design practice to provide communicating drains between upper chambers of the engine which contain oil lubricated components, such as for example the valve chamber or rocker box of overhead valve type engines, and the lower crankcase and sump chamber defined by the cylinder block and oil pan in which the supply of engine oil lubricant is stored. Such drains are normally provided by internal passages formed within the cylinder block and connecting the upper and lower chambers.

Further, it is recognized that a large wall area may be made structurally more rigid and strengthened with a limited increase in weight by the suitable integration of stiffening ribs as a part of the wall structure. This method of strengthening and stiffening the housing of mechanical machinery has become an accepted way of reducing the sound producing vibration characteristics of such devices to provide more quiet operation with a limited addition of weight or increase in cost.

SUMMARY OF THE INVENTION

The present invention combines some of the known features of the prior art with new features in a novel integrated engine construction that provides a unique manner of mounting an oil level indicating gauge and of providing upper chamber lubricant return drains in which these features are in part incorporated within lightened hollow stiffening ribs extending along portions of the side walls of the engine cylinder block in a manner to increase its stiffness and reduce the tendency for vibration and generation of noise. Numerous other features and advantages of the invention in its many aspects will be apparent from the following description of a preferred embodiment, taken together with the accompanying drawings.

BEST MODE FOR CARRYING OUT THE INVENTION

Figure 1:
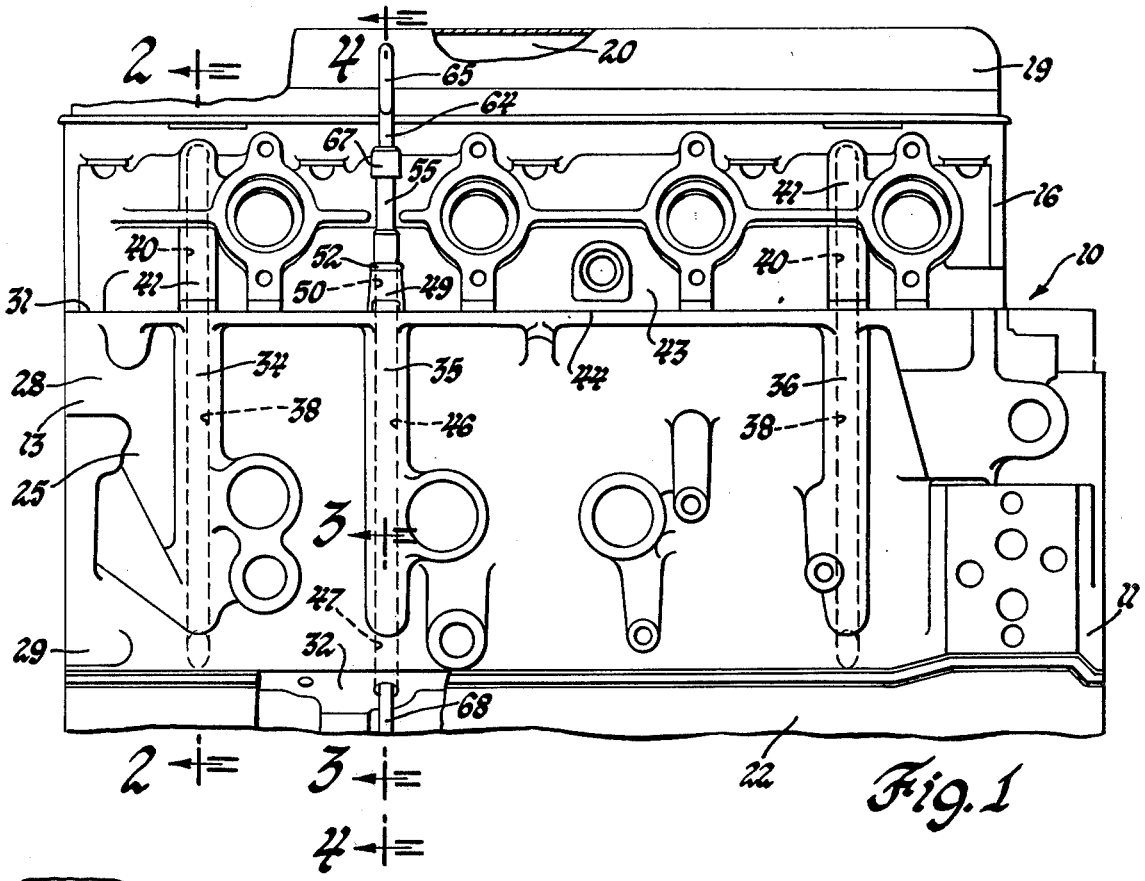
FIG. 1 is a combination side and bottom view of an automotive V-type eight-cylinder engine having the features of the invention as seen from the plane of the line 1—1 of FIG. 2 with portions broken away to disclose certain internal construction features.
Figure 2:
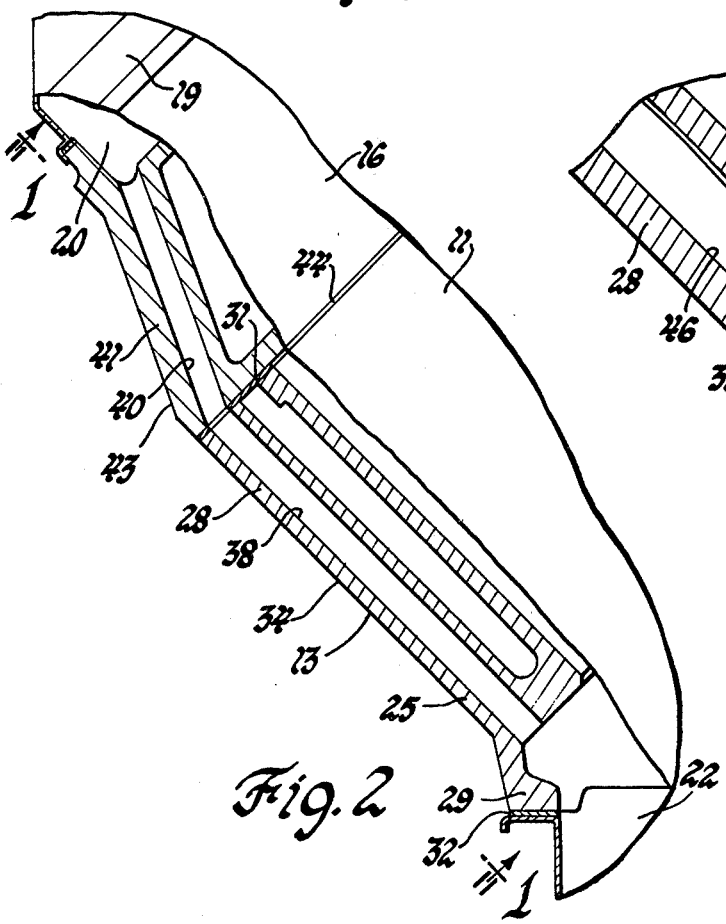
FIG. 2 is a fragmentary end view with portions seen in cross section from the plane of the line 2—2 of FIG. 1 and illustrating certain features of drain means, in accordance with the invention.

Referring now to the drawings in detail, numeral 10 generally indicates a V-type eight-cylinder internal combustion engine having a cylinder block 11 defining a pair of angularly disposed cylinder banks 13, 14. Cylinder heads 16, 17 are respectively mounted on the tops of cylinder banks 13, 14, each of the cylinder heads having a rocker cover 19 mounted on its upper surface and defining therewith an enclosed oil lubricated valve chamber or cavity 20. At the bottom of the block 11 an oil pan 22 is mounted which encloses the lower portion of the engine crankcase to define a crankcase and oil sump lower chamber and provide a sump for the storage of lubricating oil used in lubrication of the engine's moving parts.

The engine cylinder block is conventionally provided with a pair of oppositely disposed side walls 25, 26, each of which extends longitudinally to the front and rear ends of the block and includes angularly disposed upper and lower portions 28, 29, respectively. The upper portions each have upper cylinder head mounting surfaces 31 on which the respective cylinder heads are seated, while the lower portions in like manner have lower oil pan mounting surfaces 32 to which the oil pan is attached.

Each of the engine side walls 25, 26 includes a group of three longitudinally spaced upwardly extending thickened portions defining ribs 34, 35, 36 which extend from the upper cylinder head mounting surface of their respective walls downwardly to their respective lower wall portions above their lower pan mounting surfaces. All of the ribs are hollow by reason of their having passages drilled in the wall within the confines of the ribs and extending for their full length. Ribs 34 and 36 define straight through-drilled passages 38 which extend from the upper cylinder head mounting surface 31 through the inner side of the wall near the juncture of the upper and lower wall portions where they open into the enclosed crankcase and oil sump chamber.

Upwardly of the block, passages 38 join with connecting passages 40 which extend through thickened ribs 41 in the respective outer wall 43 of the cylinder head connecting the lower surface 44 thereof with the bottom of the upper valve chamber or cavity 20 enclosed by the rocker cover 19. Passages 38 and 40 thus combine to form oil drain passages connecting the upper valve chambers with the crankcase to provide for the return of lubricating oil from the upper chambers to the oil sump.

Figure 3:
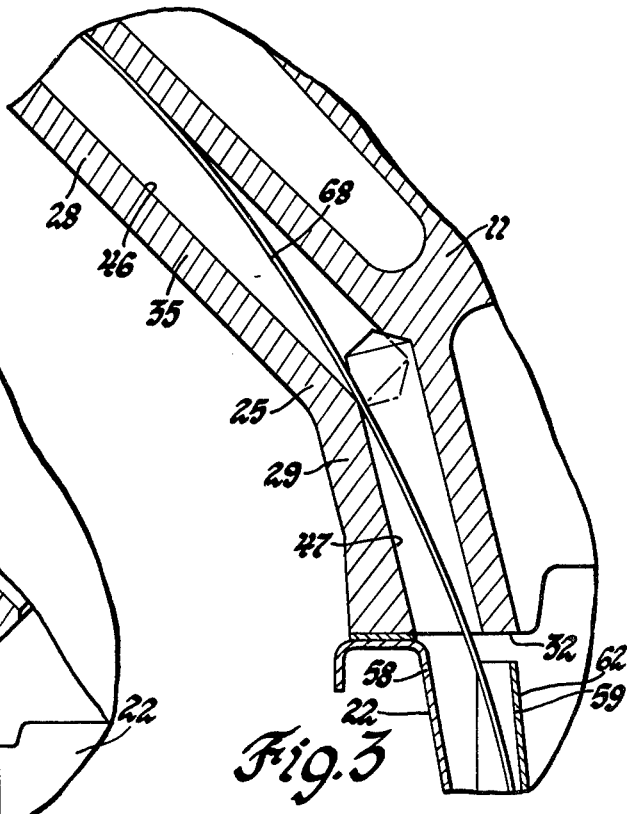
FIG. 3 is an enlarged fragmentary cross-sectional view of a portion of the oil gauge mounting means as viewed from the plane of the line 3—3 of FIG. 1.
Figures 4, 5, 6, 7, 8:
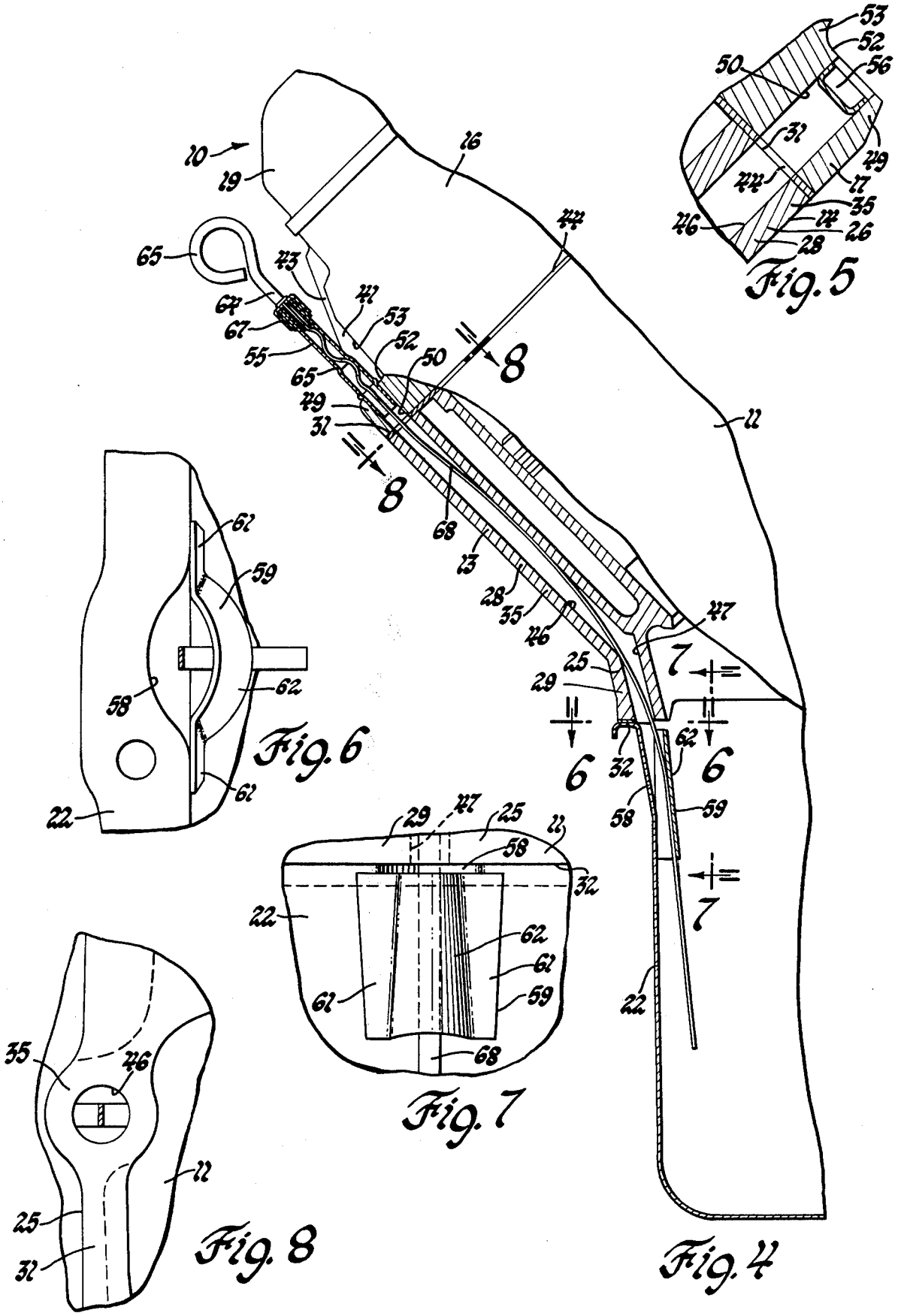
FIG. 4 is a fragmentary end view having portions broken away to show the oil gauge mounting arrangement as viewed from the plane of the line 4—4 of FIG. 1.
FIG. 5 is a fragmentary cross-sectional view showing a plugged alternate oil gauge mounting bore on the opposite side of the cylinder block from the active mounting means.
FIG. 6 is a view looking downwardly on the oil pan from the plane of the line 6—6 of FIG. 4 and illustrating the dipstick guide arrangement.
FIG. 7 is an interior side view from the plane of the line 7—7 of FIG. 4 showing the pan mounted dipstick guide.
FIG. 8 is a view of the upper wall of the cylinder block from the plane of the line 8—8 of FIG. 4 illustrating the configuration of the hollow stiffening rib which forms a portion of the oil gauge mounting means for the engine.

The case of the intermediate ribs 35 in the side walls of the cylinder block differs from that of the end oil drain defining ribs 34, 36. The thickened rib portions 35 of the upper walls define first drilled bores or passages 46 extending from their respective upper wall portions downwardly to about the juncture of the respective upper and lower portions of the wall. Here, the first bores are intersected by second bores or passages 47 drilled upwardly in thickened parts of the lower wall portions from their lower oil pan mounting surfaces 32. The angular intersections of the drilled bores or passages are controlled so that the ends of the second bores extend beyond their junctures sufficiently to completely encompass the ends of the respective first bores, as may be best seen in the enlarged view of FIG. 3. The purpose of this arrangement will be subsequently described.

Each of the engine cylinder heads 16, 17 includes, above the location of the corresponding thickened rib portion 35 of the cylinder block, a corresponding short boss portion 49 containing a short bore 50 forming a coaxial extension in the cylinder head of the associated first bore 46 in the cylinder block. The boss portion 49 in each head has a flattened upper surface 52 adjacent a recessed portion 53 of the cylinder head to provide for the installation in either boss of an oil gauge supporting member. Such a member in the form of a tubular oil gauge support 55 is press fitted into the upper end of the bore 50 of cylinder head 16, while the upper end of bore 50 of cylinder head 17 is closed by a pressed-in plug 56.

The wall of the engine oil pan below the opening of second bore 47 into the enclosed lower chamber is deformed outwardly at 58 so as to align it with the outer edge of the second bore 47. Inwardly of this deformed portion there is provided a dipstick guide member 59 which is secured to the pan wall by ears 61 on opposite sides of the deformed portion and includes an inwardly deformed guide portion 62 that extends inwardly of and generally along the adjacent oil pan wall and slightly inwardly of the inner edge of the second bore 47 at its opening into the lower chamber.

As is apparent from the drawings, the angularly disposed bores or passages 46, 47 defined in part by the wall ribs 35 of the cylinder block combine with the bores 50 of the cylinder head to define an internal uniplanar passage which is adapted to receive an oil gauge rod or dipstick. In the case of the right hand cylinder bank 14, as viewed in FIG. 5 of the drawings, this passage is plugged and is not used. However, the passage associated with the left hand cylinder bank 13 shown in FIGS. 1–4 is further provided with the oil gauge support 55 mounted in the cylinder head and dipstick guide 59 mounted in the oil pan, thus constituting the required means for mounting a dipstick or oil gauge rod in the engine.

Such a dipstick 64 is provided as shown in the drawings in its normally installed position. Dipstick 64 includes a curved upper handle portion 65 connecting with a cap element 67 that fits over and closes the end of the tubular support member 55. A flexible steel indicating rod 68 extends from the handle and cap member downwardly through the support 55 and bores 50, 46 and 47 against the guide 59 which deflects the lower portion of the rod downwardly, closely along the side of the oil pan where it terminates at a point below the usual level of oil in the sump.

It should now be apparent that the previously described manner of overlapping the drilled bores 46 and 47 so that the end of bore 46 is completely contained within bore 47, and the particular positioning of the dipstick guide 59 are necessary to provide for the insertion of the dipstick into its mounting and to insure its smooth passage down the wall passages and its deflection into a position along the oil pan side wall clear of the moving parts of the engine located within the crankcase enclosure. With this construction, the dipstick mounting means is comprised of relatively simple additions to the drilled passages in the cylinder block and head which additions may be alternatively mounted on either side of the engine as may be appropriate in accordance with the particular engine installation.

The combined features of the invention as above described may now be seen to provide the advantages of stiffening of the cylinder block outer wall through provision of the thickened ribs 34, 35 and 36 which being made hollow in a manner that reduces excessive weight also provide passages for oil drains from the oil lubricated upper valve cavities above the cylinder heads to the oil sump as well as novel means for mounting an oil gauge rod in the outer walls and cylinder head of an internal combustion engine. While the various features and advantages of the invention have been illustrated by reference to a particular preferred embodiment, it should be understood that numerous changes could be made within the spirit and scope of the inventive concepts described. Accordingly, it is intended that the invention not be limited except in accordance with the language of the following claims.

The embodiments of the invention in which an exclusive property or privilege is claimed are defined as follows:

1. In an internal combustion engine, the combination comprising a cylinder block having a side wall extending longitudinally to front and rear ends and including an upper cylinder head mounting surface and a lower surface on which an oil pan is mounted, defining with said block an enclosed lower chamber an upstanding rib-like boss on said wall disposed longitudinally intermediate said ends and extending at least part way between said upper and lower surfaces, and an internal passage within said boss and said wall, extending through said upper surface and opening from the wall into said lower chamber, said boss and passage defining a lightened stiffening rib for reducing vibration of and resulting noise transmission from said wall as well as means for access to said lower chamber through said side wall.

2. The combination of claim 1 wherein said passage connects through a second passage in the wall of a cylinder head mounted on said upper surface with an upper valve cavity defined in part by said head to define drain means between said valve cavity and said lower chamber.

3. In an internal combustion engine, the combination comprising a cylinder block having a side wall extending longitudinally to front and rear ends and including an upper cylinder head mounting surface and a lower surface on which an oil pan is mounted.

an upstanding rib-like boss on said wall disposed longitudinally intermediate said ends and extending at least part way between said upper and lower surfaces, and an internal uniplanar passage within said boss and said wall, extending through said upper surface and through said lower surface inwardly adjacent a side of said oil pan, said boss and passage defining a lightened stiffening rib for reducing vibration of and resulting noise transmission from said wall and providing for the mounting of a flexible blade oil gauge rod extending from said upper surface through said passage and into said oil pan below the normal oil level therein.

4. In an internal combustion engine, the combination comprising a cylinder block having a pair of oppositely disposed side walls each extending longitudinally to front and rear ends and including an upper cylinder head mounting surface and a lower surface on which there is mounted an oil pan, each said wall having a protruding rib-like boss disposed intermediate its said ends and extending at least part way between its respective upper and lower surfaces, and an internal uniplanar passage within each said boss and its respective wall and extending through their respective upper surfaces and through their respective lower surfaces inwardly adjacent an associated side of said oil pan, whereby said bosses and said passage together define lightened stiffening ribs for reducing vibration of and resulting noise transmission from their respective side walls and said passages provide for receiving a flexible blade oil gauge rod in either of said walls and extending from its upper surface through the associated internal passage and into said oil pan below the normal oil level therein.

5. In a V-type internal combustion engine, the combination comprising a cylinder block having a pair of oppositely disposed side walls each extending longitudinally to front and rear ends and including angularly disposed upper and lower portions, each upper portion having an upper cylinder head mounting surface and each lower portion having a lower surface and an oil pan mounted on said lower surfaces, each said wall having a protruding rib-like boss disposed intermediate its ends and extending at least part way between its upper and lower surfaces, and an internal uniplanar passage within each said boss and its respective wall, each passage including a first drilled bore in the respective upper wall portion extending from its upper surface to the juncture of the respective upper and lower wall portions and a second drilled passage in the respective lower wall portion extending from its lower surface to the juncture of the respective upper and lower wall portions, each said first bore ending at its associated second bore which extends beyond said juncture sufficiently to completely encompass the end of the respective first bore, the second bores opening through their respective lower surfaces inwardly adjacent an associated side of said oil pan, whereby said bosses and said passages together define lightened stiffening ribs for reducing vibration and resulting noise transmission from their respective side walls and said passages provide for receiving a flexible blade oil gauge rod in either of said walls extending from its upper surface through its passage and into said oil pan below the normal oil level therein.

6. The combination defined in either of claims 4 or 5 and further comprising cylinder head means mounted on said block on said side wall upper cylinder head mounting surfaces, and dual mounting means on said cylinder head means for receiving an oil gauge rod, said mounting means including passages through the cylinder head means and aligned with the internal passages of both the side walls whereby said gauge rod may selectively be arranged to extend through and be supported by either of said mounting means.

7. A combination as defined in claim 6 wherein a gauge rod support tube is secured in one of said cylinder head passages while the other of the cylinder head passages is closed by a plug.

8. A combination as defined in claim 7 and further including a guide member secured to the interior of a side of said oil pan below the one side wall passage that is aligned with the cylinder head passage in which said support tube is secured, said guide member including a wall portion spaced inwardly of said one side wall passage and angled downwardly at a steeper angle to engage the blade of an oil gauge rod received in said one side wall passage and to deflect said blade toward said one oil pan side.

* * * * *